US009881526B2

(12) United States Patent
Sakko

(10) Patent No.: US 9,881,526 B2
(45) Date of Patent: Jan. 30, 2018

(54) MATERIAL TO INCREASE TRAFFIC SIGN AWARENESS

(71) Applicant: Michael Winston Sakko, Winter Haven, FL (US)

(72) Inventor: Michael Winston Sakko, Winter Haven, FL (US)

( * ) Notice: Subject to any disclaimer, the term of this patent is extended or adjusted under 35 U.S.C. 154(b) by 0 days.

(21) Appl. No.: 14/634,861

(22) Filed: Mar. 1, 2015

(65) Prior Publication Data

US 2016/0253931 A1 Sep. 1, 2016

(51) Int. Cl.

| | |
|---|---|
| ***G09F 13/16*** | (2006.01) |
| ***E01F 9/60*** | (2016.01) |
| *G09F 3/10* | (2006.01) |
| *G09F 7/18* | (2006.01) |

(52) U.S. Cl.

CPC ..... *G09F 13/16* (2013.01); *E01F 9/60* (2016.02); *G09F 3/10* (2013.01); *G09F 7/18* (2013.01)

(58) Field of Classification Search

CPC ..... G09F 3/10; G09F 2003/023–2003/025; G09F 7/17; G09F 7/20

See application file for complete search history.

(56) References Cited

U.S. PATENT DOCUMENTS

| | | | | | |
|---|---|---|---|---|---|
| D212,787 | S * | 11/1968 | McCormick | D10/109.1 | |
| 5,560,131 | A * | 10/1996 | Gibson | G09F 7/20 | 40/607.12 |
| 6,158,379 | A * | 12/2000 | Burlando | G09F 7/18 | 116/63 P |
| D566,778 | S * | 4/2008 | Newbill | D20/41 | |
| D589,092 | S * | 3/2009 | Glover | D20/17 | |
| 2002/0020088 | A1* | 2/2002 | Kreutner | B65D 5/0236 | 40/312 |
| 2009/0178318 | A1* | 7/2009 | Parenti | E01F 9/623 | 40/607.01 |
| 2014/0230164 | A1* | 8/2014 | Wilson | A43B 23/24 | 12/142 P |

OTHER PUBLICATIONS

Pre Printed Carton Sealing Tape, http://www.topmailers.com/Printed-Packing-Tape-Top-Mailers-s/136.htm Feb. 18, 2012.*

* cited by examiner

*Primary Examiner* — Cassandra H Davis

(57) ABSTRACT

Material for a sign support structure, such as a signpost, providing greater visibility an added awareness to the sign comprising a film or sheeting on which is printed contrasting colored segments or contrasting colored designs, words, or letters replicated repeatedly on or within and along the length of the material. The material, when attached to the sign support structure or an independent substrate that is subsequently attached to the sign support structure, provides a higher visibility pattern drawing awareness to the sign.

4 Claims, 12 Drawing Sheets

MATERIAL TO INCREASE TRAFFIC SIGN AWARENESS

CROSS-REFERENCE TO RELATED APPLICATIONS

This application claims the benefit of PPA Ser. No. 61/966,721 filed Mar. 1, 2014 by the present inventor.

FEDERALLY SPONSORED RESEARCH

None

SEQUENCE LISTING

None

BACKGROUND

Field

The present invention relates to signs and their support structure or any device that is used to regulate, inform, or give notice to the public or other entities.

Background of the Invention

Signs are a necessity to inform the public or other entities of various conditions or regulations. In areas where signs are used for traffic control, such as intersections, there are times where these signs are not as visible as necessary for safety. Tree branches or other vegetation may obscure some signs while others are so high that when viewed at a close distance the actual sign is not noticeable. The sign is installed for the purpose of informing or to notify the public therefore it seems prudent to make it as visible or conspicuous as possible. Drivers' failure to notice traffic signs at intersections cause many accidents. There are many types of accidents caused by a driver not seeing a traffic sign. There is a need to draw attention to and make signs more visible or conspicuous so that some of these type accidents may be prevented.

Signs are mounted on various support structures; two examples being a round shape post or a u-shaped or v-shaped profile stamped or extruded post. When these structures are used for the sole purpose of mounting a sign there is an available substrate or base for mounting a material or an assembly that can provide additional visibility and awareness to the sign it supports. Since numerous signs are mounted vertically at a predetermined height on a vertical post there is an area between the ground and actual sign that can be utilized to provide added visibility or awareness. This area can be used to provide added visibility or awareness to a sign by using it as a substrate on which to apply a retro-reflective material either as a single retro-reflective material or as a reinforced or supported retro-reflective material which is adhered to an independent substrate, such as aluminum or plastic sheet, which is then secured to this area. As an example, a round signpost may be a substrate for a flexible retro-reflective material and a u-shaped or v-shaped stamped or extruded contoured metal post may be a substrate for a rigid material on which a retro-reflective material is applied.

Advantages

By providing added visibility to a necessary structure of a sign assembly such as but not limited to a vertical support post of a traffic sign, one may assume accidents will be reduced. The added visibility results from the application of a retro-reflective film, sheeting or other material, device or assembly with contrasting color, design, words or letters replicated repeatedly along the length of the material which is adhered to or attached to a sign support structure.

By applying a retro-reflective material with segments of contrasting colors, designs, words or letters replicated repeatedly along the length of the material, device or assembly, to the previously unmarked area of a sign support structure for added visibility, visible information can be obtained pertaining to the type of sign it is supplementing. One example is a clear/white retro-reflective film or sheeting on which is printed transparent red patterns repeated at spaced intervals along the length of the clear/white material resulting in a retro-reflective red/white pattern on a vertical signpost. Another example would be a standard octagonal red retro-reflective stop sign mounted on an upright post having adhered to the post a retro-reflective film or sheeting on which is printed transparent red colored patterns on a white/clear background replicated repeatedly along its length. Alternatively a retro-reflective material on which is printed a design outlining the word STOP in contrasting color could be spelled out along with other contrasting colors. Although the examples describe supplementing stop signs, other possibilities exist for YIELD, SCHOOL, evacuation route and other signs such as no entry, no parking etc.

It is obvious that greater visibility or awareness toward a sign can be obtained by the addition of contrasting colors or areas of contrasting colors, designs, words or letters repeatedly spaced on a retro-reflective film or sheeting applied to the support structure of a sign. The previous example of a retro-reflective material with contrasting transparent colors printed and repeated at spaced intervals of white-red-white-red-white etc. is only one example since other materials and color combinations may be used.

SUMMARY

The object of the invention is to increase the public awareness of traffic signs or the like by making them more conspicuous and drawing attention to them by utilizing the necessary sign support structure as a substrate on which to adhere a high visibility material with contrasting colors.

In accordance with one embodiment, a material has incorporated on or within it alternating segments of contrasting colors replicated repeatedly or alternating patterns of colors, designs, words or letters replicated repeatedly, along its length and is applied to a sign support structure. This application to a substrate, such as a signpost, increases the awareness of the sign it supports. These patterns are arranged so that when applied to a sign support structure or to an independent substrate which a subsequently applied to a sign support structure and viewed by an onlooker, the structure and sign are noticeably more visible. This creates added visibility and awareness to regulating, warning, guide, school, informative signs, or the like, that are mounted on the support structure. When the sign support structure is such that a material will not adhere to an adequate surface, such as a U-shaped post, an independent substrate is used as a support for the retro-reflective material and subsequently fastened to the post. The invention is not limited to any material, color, design, words or letters. Any design may be replicated repeatedly on a material in contrasting colors. The material may be adhered to a sign support structure or base assembly of a specific sign as a supplement to increase awareness to the sign, or adhered to an independent substrate that is subsequently fastened to a sign support structure.

DRAWINGS

Reference Numerals

Figures 1, 1A, 1B, 2, 2A, 2B:
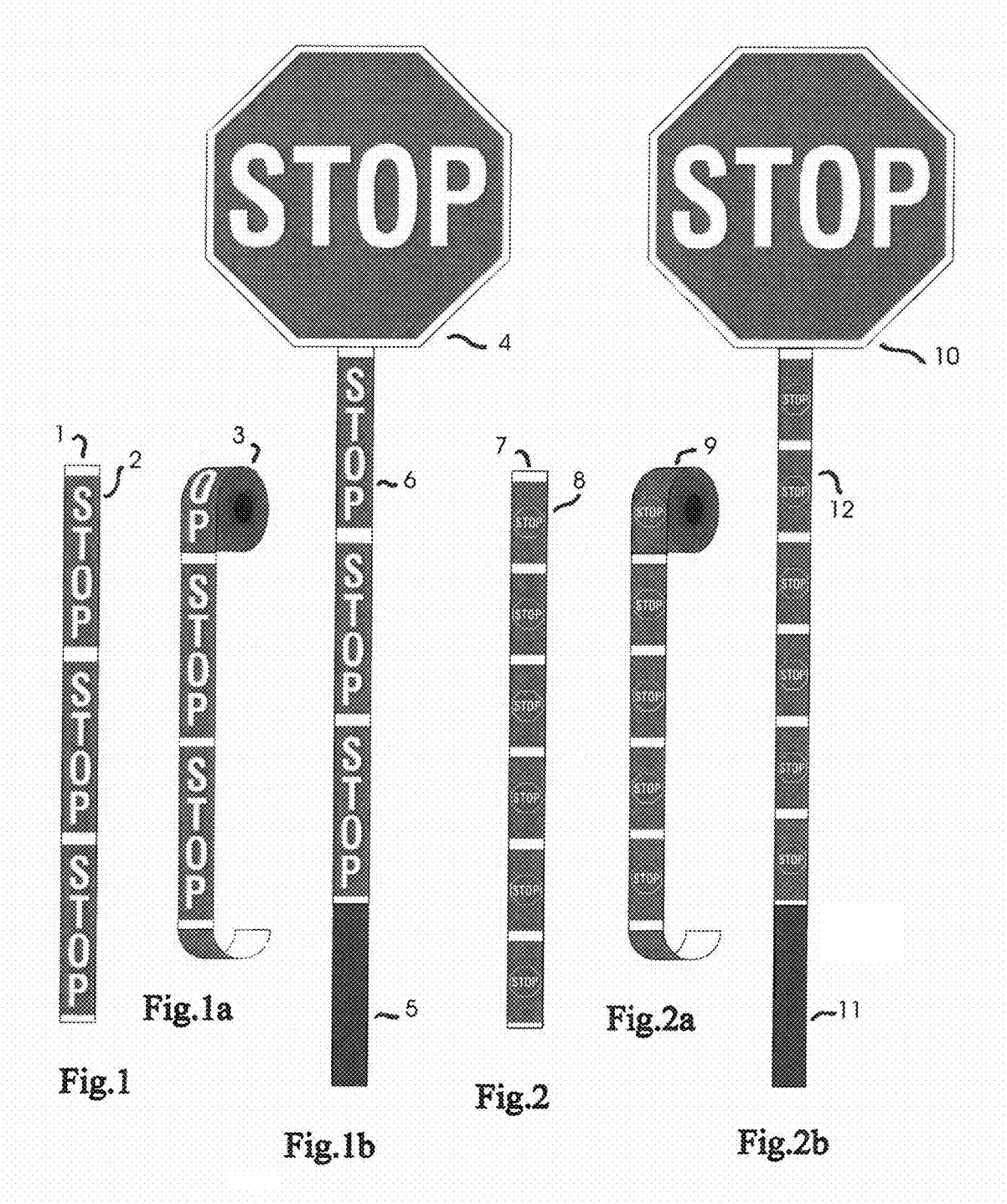
FIG. 1 is a front view of my invention showing a retro-reflective base material on which letters are applied in contrasting colors.
FIG. 1*a* is a perspective view of my invention, in a roll form, showing a retro-reflective base material on which letters are applied in contrasting colors.
FIG. 1*b* is a front view showing a STOP sign and support structure with the material in FIG. 1 or FIG. 1*a* applied to the support structure.
FIG. 2 is a front view of my invention showing a retro-reflective base material on which a logo is applied in contrasting colors.
FIG. 2*a* is a perspective view of my invention, in a roll form, showing a retro-reflective base material on which a logo is applied in contrasting colors.
FIG. 2*b* is a front view showing a STOP sign and support structure with the material in FIG. 2 or FIG. 2*a* applied to the support structure.
Figures 3, 3A, 3B, 4, 4A, 4B:
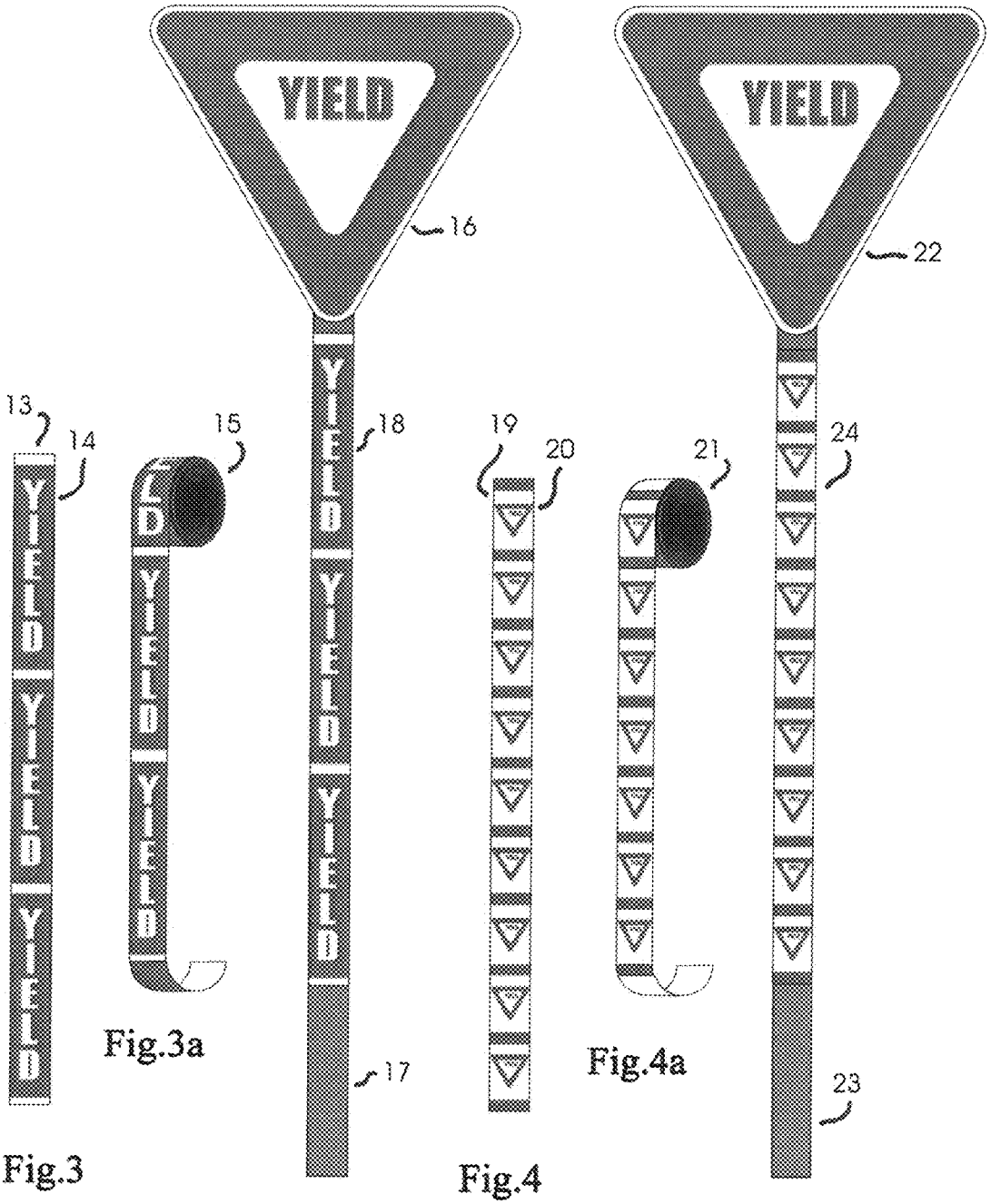
FIG. 3 is a front view of my invention showing a retro-reflective base material on which letters are applied in contrasting colors.
FIG. 3*a* is a perspective view of my invention, in a roll form, showing a retro-reflective base material on which letters are applied in contrasting colors.
FIG. 3*b* is a front view showing a YIELD sign and support structure with the material in FIG. 3 or FIG. 3*a* applied to the support structure.
FIG. 4 is a front view of my invention showing a retro-reflective base material on which a logo is applied in contrasting colors.
FIG. 4*a* is a perspective view of my invention, in a roll form, showing a retro-reflective base material on which a logo is applied in contrasting colors.
FIG. 4*b* is a front view showing a YIELD sign and support structure with the material in FIG. 4 or FIG. 4*a* applied to the support structure.
Figures 5, 5A, 5B, 6, 6A, 6B:
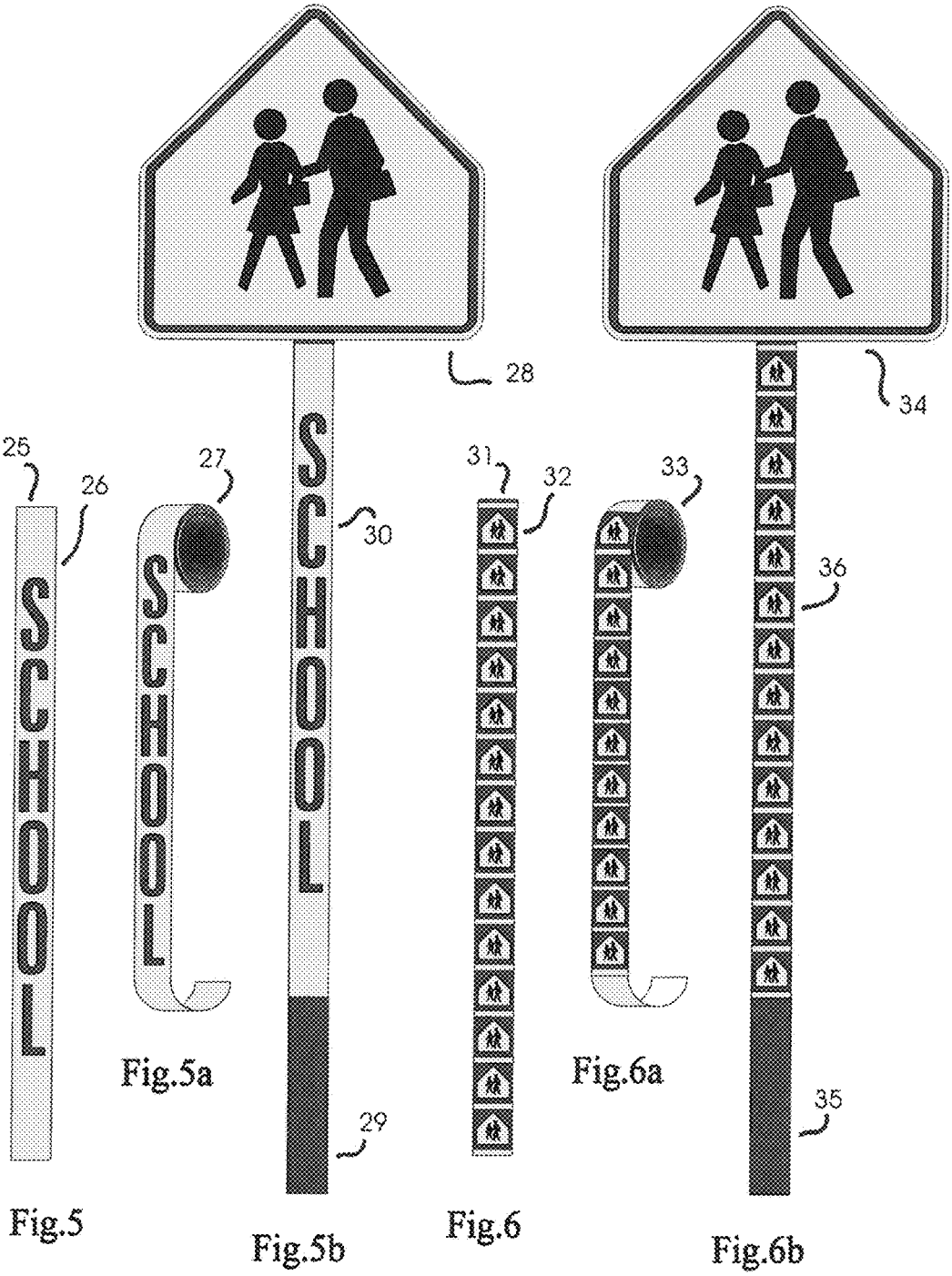
FIG. 5 is a front view of my invention showing a retro-reflective base material on which letters are applied in contrasting colors.
FIG. 5*a* is a perspective view of my invention, in a roll form, showing a retro-reflective base material on which letters are applied in contrasting colors.
FIG. 5*b* is a front view showing a SCHOOL sign and support structure with the material in FIG. 5 or FIG. 5*a* applied to the support structure.
FIG. 6 is a front view of my invention showing a retro-reflective base material on which a logo is applied in contrasting colors.
FIG. 6*a* is a perspective view of my invention, in a roll form, showing a retro-reflective base material on which a logo is applied in contrasting colors.
FIG. 6*b* is a front view showing a SCHOOL sign and support structure with the material in FIG. 6 or FIG. 6*a* applied to the support structure.
Figure 7:
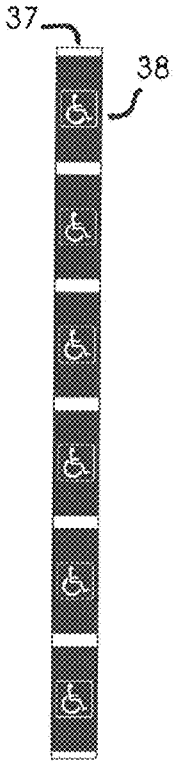
FIG. 7 is a front view of my invention showing a retro-reflective base material on which a logo is applied in contrasting colors.
Figure 7A:
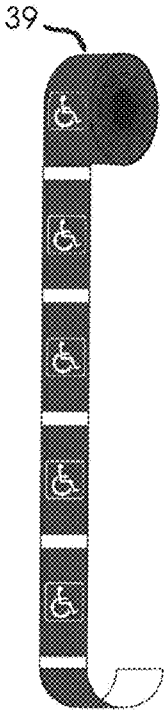
FIG. 7*a* is a perspective view of my invention, in a roll form, showing a retro-reflective base material on which a logo is applied in contrasting colors.
Figure 7B:
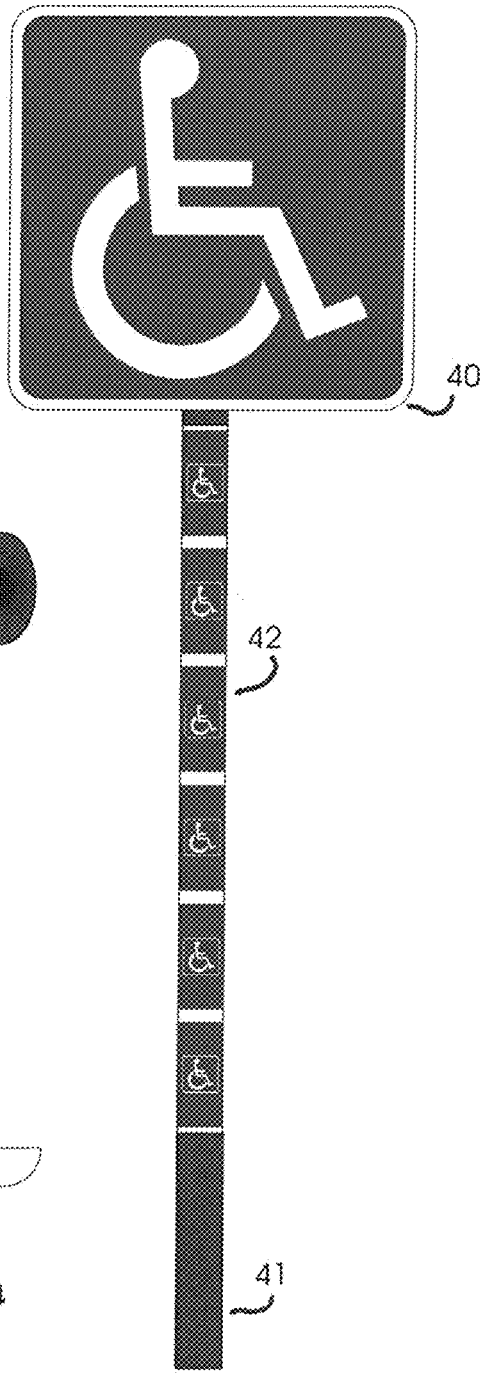
FIG. 7*b* is a front view showing a HANDICAP sign and support structure with the material in FIG. 7 or FIG. 7*a* applied to the support structure.

1. retro-reflective film or sheet material
2. contrasting letters or words applied to film or sheet material in a precut form.
3. roll form of film or sheet material with contrasting letters or words applied.
4. stop sign.
5. sign support structure.
6. printed film or sheet material applied to support structure.
7. retro-reflective film or sheet material.
8. contrasting design or logo applied to film or sheet material in a precut form.
9. roll form of film or sheet material with contrasting design or logo applied.
10. stop sign.
11. sign support structure.
12. printed film or sheet material applied to support structure.
13. retro-reflective film or sheet material.
14. contrasting letters or words applied to film or sheet material in a precut form.
15. roll form of film or sheet material with contrasting letters or words applied.
16. Yield sign.
17. sign support structure.
18. printed film or sheet material applied to support structure.
19. retro-reflective film or sheet material.
20. contrasting design and logo applied to film or sheet material in a precut form.
21. roll form of film or sheet material with design and logo applied.
22. yield sign.
23. sign support structure.
24. printed film or sheet material applied to support structure.
25. retro-reflective film or sheet material.
26. contrasting letters or words applied to film or sheet material in a precut form.
27. roll form of film or sheet material with letters or words applied.
28. school sign.
29. sign support structure.
30. printed film or sheet material applied to support structure.
31. retro-reflective film or sheet material.
32. contrasting design or logo applied to film or sheet material in a precut form.
33. roll form of film or sheet material with design or logo applied.
34. school sign.
35. sign support structure.
36. printed film or sheet material applied to support structure.
37. retro-reflective film or sheet material.
38. contrasting design or logo applied to film or sheet material in a precut form.
39. roll form of film or sheet material with design or logo applied.
40. handicap sign.
41. sign support structure.
42. printed film or sheet material applied to support structure.
43. retro-reflective film or sheet material.
44. contrasting letters or words applied to film or sheet material in a precut form.
45. substrate for mounting film or sheet material to attach to a support structure of sign.
46. mounting holes.
47. roll form of film or sheet material with letters or words applied as being applied to a substrate.
48. sign.
49. sign support structure.
50. printed film or sheet material applied to a independent substrate and attached to support structure.
51. colored substrate for mounting material to attach to a support structure of sign.
52. mounting holes.
53. roll form of clear transparent film or sheet material with printed contrasting letters or words being applied to a colored substrate.
54. contrasting colored lettering.
55. clear transparent film or sheet material with printed contrasting colored letters applied or laminated to an independent colored substrate.
56. contrasting colored lettering.
57. roll form of clear transparent film or sheet material with contrasting letters or words.
58. sign.
59. sign support structure.
60. clear transparent film or sheet material with contrasting colored letters applied or laminated to an independent colored substrate, as in FIG. 12*a*, attached to the sign support structure showing the substrate color through the printed clear transparent material creating a contrasting colored higher visibility pattern.
61. clear or transparent decal type material with design or logo in precut form.
62. Contrasting design or logo applied to clear or transparent film or sheet material.
63. clear or transparent film or sheet material.
64. contrasting color design or logo printed on clear or transparent material.
65. roll form of clear or transparent film or sheet material with contrasting design or logo applied.
66. sign.
67. sign support structure.
68. clear or transparent film or sheet material with contrasting colored design or logo applied to a single colored support structure showing the support structure color through the printed clear transparent material creating a contrasting colored higher visibility pattern.

DETAILED DESCRIPTION

First Embodiment—FIG. 1-FIG. 11

Figure 8:
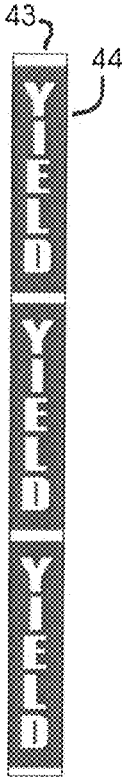
FIG. 8 is a front view of my invention before being applied to an independent substrate.
Figure 9:
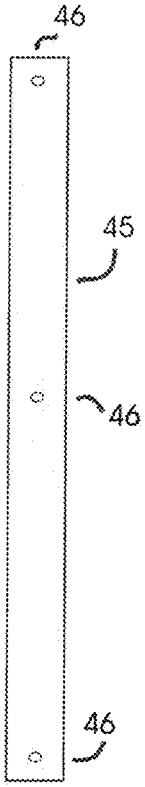
FIG. 9 is a front view of the independent substrate on which my invention is to be applied prior to installation on a support structure of a sign.
Figure 10:
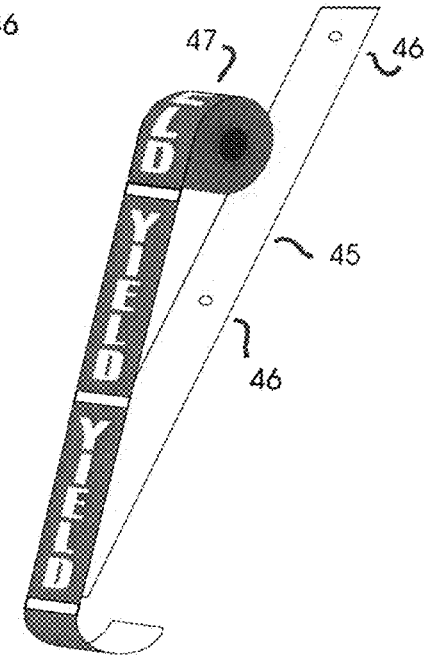
FIG. 10 is a perspective view of my invention, in roll form, being applied to an independent substrate prior to installation to a support structure of a sign.
Figure 11:
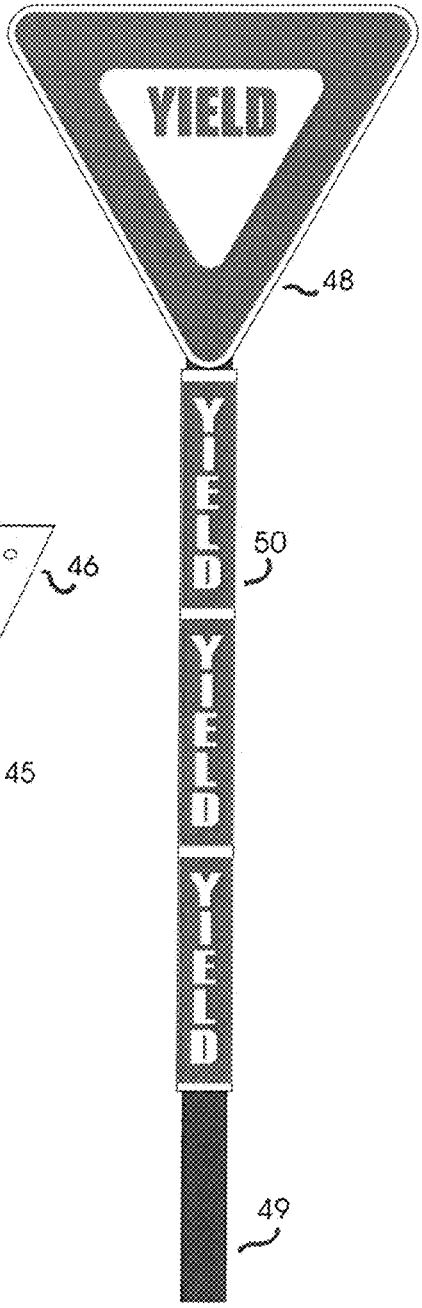
FIG. 11 is a front view of my invention after being applied to a substrate and installed on a support structure of a sign.

As illustrated in FIG. 1. a retro-reflective material 1 is produced by using any of the various printing methods resulting in contrasting colors, designs, logos, words or letters. In FIG. 1 the design 2 outlining the word STOP is replicated repeatedly along the length of the material. The material illustrated in FIG. 1 can be either a single printed piece or a section cut from the roll illustrated in FIG. 1*a*. FIG. 1*b* shows a stop sign 4 mounted on a support structure 5 and either a single piece of retro-reflective film or sheeting as illustrated in FIG. 1 or a cut portion of a roll of retro-reflective film or sheeting as in FIG. 1*a* is adhered to the sign support structure 5. FIG. 2-FIG. 7*b* are for illustrative purpose and show some of the various applications. FIG. 8 is another example of a single piece of a retro-reflective film or sheet material 43 with printed design 44 outlining the word YIELD. When the sign support structure is such that a film or retro-reflective sheeting will not adhere due to an inadequate surface, such as a U-shaped post, an independent substrate 45 as illustrated in FIG. 9 is used as a support for the retro-reflective material. In FIG. 9 the independent substrate 45 is shown with holes 46 to mount to a sign support structure. FIG. 10 illustrates a roll form of the material 47 being applied to the independent substrate 45. FIG. 11 illustrates the assembled unit 50, of FIG. 10 as applied to sign support structure 49 of the Yield sign 48.

Retro-reflective material is applied to an existing sign support structure, such as but not limited to a post holding a traffic sign or any other informative sign, to make more visible or add to the awareness of the sign or signs. The material applied to the support structure is printed or overlaid with contrasting colors, designs, words or letters. These colors, designs, words or letters are replicated repeatedly the entire length of the material in contrasting colors so when applied to the sign support structure, add to the visibility and increase the awareness of signs.

One of the ways to accommodate the application of the material to a sign support structure is to adhere retro-reflective material to a separate independent substrate, such as a plastic or aluminum sheet, for mounting to an existing structure, such as a stamped metal sign post that has an open profile that is not adequate for adhering a film or sheeting. The separate independent substrate provides support for the material that could otherwise not be applied to the sign support structure. By adhering or fastening a higher visibility material or assembly to the necessary structure of, but not limited to a vertical signpost, visibility to and awareness of the sign is increased alerting one to the sign or notice. The retro-reflective material for application to the area necessary to support and mount a sign can also be a high daytime visibility material for supplementing or providing more awareness to signs placed mostly for daytime information such as a school zones or pedestrian crossings. Retro-reflective material for night visibility can have both day and night visibility if required. Although the previously mentioned materials have been a retro-reflective film or sheeting, the invention is not limited to such, since other materials may be used. Certain modifications can be made without deviating from the intent or scope of the invention.

The retro-reflective material produced with alternating contrasting colors such as, but not limited to, a white/clear material with repeating red areas along its length so that when placed on a substrate the white/clear alternate with the red so as to draw more attention. Retro-reflective material may be manufactured, in a single color with alternating contrasting colors or with contrasting designs, words or letters replicated repeatedly along the desired length, or obtained from any of the film or sheeting manufactures and printed by digital printer, heat transfer film, screen printed or by any other means to apply words or a design of the desired shape and color. The desired shape can be, but is not limited to, a smaller pattern representing any of the regulatory, warning, guide and emergency signs. Alternately the material could be obtained from any of the film or sheeting manufacturers with designs or words incorporated within or applied during the manufacturing process.

As known by anyone skilled in the art of retro-reflective manufacturing and materials, when using certain retro-reflective film or sheeting the orientation of the sheeting affects the brightness of the reflected light. The manufacturing process that produces film or sheeting for traffic sign support structures has to take into consideration the layout of the mold, die or tooling when manufactured. When the manufactured film or sheeting is applied to a substrate in the necessary or required orientation, such as but not limited to, from ground to a sign face, the reflective values should be the highest possible in front and center of the sign post then the reflective values gradually decrease left and right of center. A person skilled in the art of retro-reflective material manufacturing may orient mold, die, or tooling in such a way as to have the highest value of reflectivity at 0 degree observation angle with gradual decreasing reflectivity values from 0 degrees to left 30 degrees or more and from 0 degrees to right 30 degrees or more when material is in an upright position rather than have the orientation of mold, die or tooling 90 degrees in another direction where reflectivity is less. The purpose of the previously mentioned orientation of the mold, die or tooling during manufacturing is to end up with a retro-reflective material that when applied to the final structure has the highest possible brightness and visibility to the field of view of a driver when approaching. Alternately if in manufacturing one cannot keep alignment of mold, die or tooling in the orientation for the highest value of retro-reflectivity desired the printing of patterns and colors may be offset at 90 degrees. This only takes into account a film or sheeting with certain elements that give a significant difference in reflectivity based on orientation. Ultimately when material is placed on a sign support structure or independent substrate subsequently adhered to a sign support structure so that printing of contrasting color, design, words or letters is legibly read in a vertical/normal orientation, the reflectivity from all angles should be by a manufacturing process that results in the highest reflectivity. Repeating contrasting colors, designs, words, letters or messages on the film or sheeting can be cut in desired length preferably used for, but not limited to, vertical application. Visibility and awareness to signs is increased by the application of the printed retro-reflective film or sheeting to vertical signposts or to an independent substrate that is subsequently adhered to vertical signposts.

When adding additional visibility and awareness to signs, such as but not limited to regulatory signs, the retro-reflective film or sheeting with printed and replicated designs, colors, words or letters may have an adhesive back protected with a release liner. Applying is simply removing the release liner and applying the film or sheeting to a clean post or other substrate that is subsequently adhered to the post. Imprinted film or sheeting can be in roll form or precut pieces. When using roll form, the desired length can be cut at a job site or precut at a facility for application at the job site.

ADDITIONAL EMBODIMENT

FIG. 12-FIG. 13*c*

Figure 12:
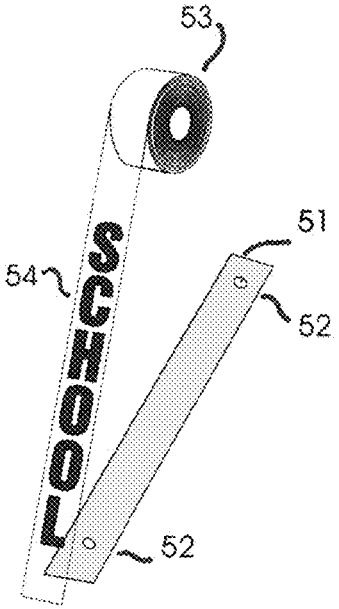
FIG. 12 is a perspective view of my invention in roll form of a printed clear transparent decal type material with contrasting dark letters being applied to an independent colored substrate prior to installation on a support structure of a sign.
Figure 12A:
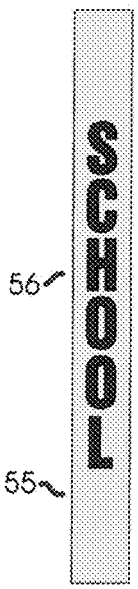
FIG. 12*a* is a front view of my invention showing a printed clear transparent decal type material with contrasting dark letters applied or laminated to an independent colored substrate resulting in a higher visible contrasting colored pattern.
Figure 12B:
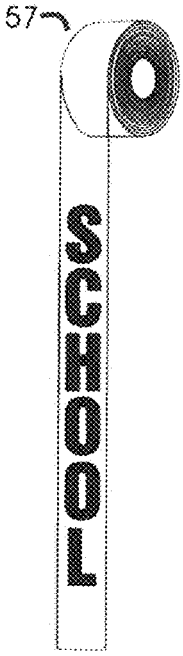
FIG. 12*b* is a perspective view of my invention, in a roll form, showing a clear transparent decal type material with contrasting dark letters for applying to a colored substrate.
Figure 12C:
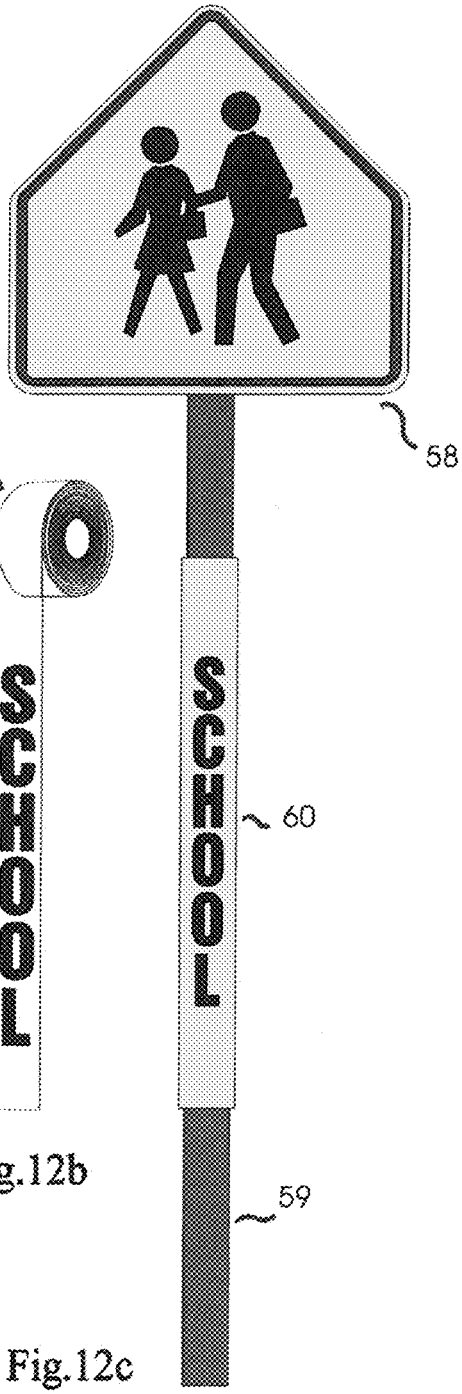
FIG. 12*c* is a front view a school sign and support showing the laminated independent colored substrate, as illustrated in FIG. 12*a*, attached to the support structure.

FIG. 12 illustrates a roll of a clear transparent film or sheeting, in roll form 53 on which is printed, in a color, the word SCHOOL 54. The clear transparent film or sheeting is illustrated as being applied to a plain color independent substrate 51 with holes 52 for mounting to a sign support structure. FIG. 12*a* is an illustration of the printed clear transparent material adhered or laminated to the colored independent colored substrate 55. FIG. 12*b* is an illustration of a printed clear transparent material and roll form of the same. FIG. 12*c* illustrates the finished product 60 of a section of the roll material 57, adhered or laminated to colored independent substrate 51, showing the contrasting colors of the word SCHOOL as in FIG. 12*a* and fastened to the sign support structure 59 of the School sign 58.

Figure 13:
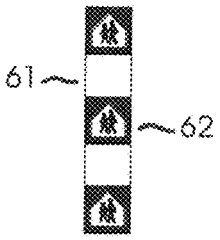
FIG. 13 is front view of my invention showing a small section of a printed clear transparent film or sheet material with contrasting dark color designs for application on a colored substrate.
Figure 13A:
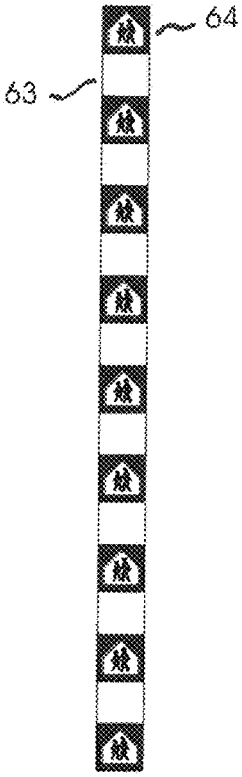
FIG. 13*a* is a front view of my invention showing a larger precut printed clear transparent film or sheet material, with contrasting dark color designs, for application onto a colored substrate.
Figure 13B:
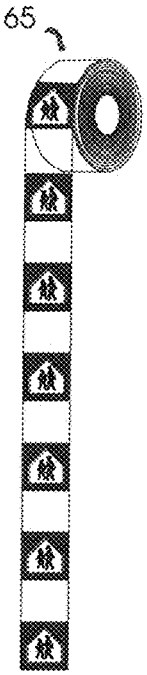
FIG. 13*b* is a perspective view of my invention, in a roll form, showing a printed clear transparent film or sheet material with contrasting dark design for application onto a colored substrate.
Figure 13C:
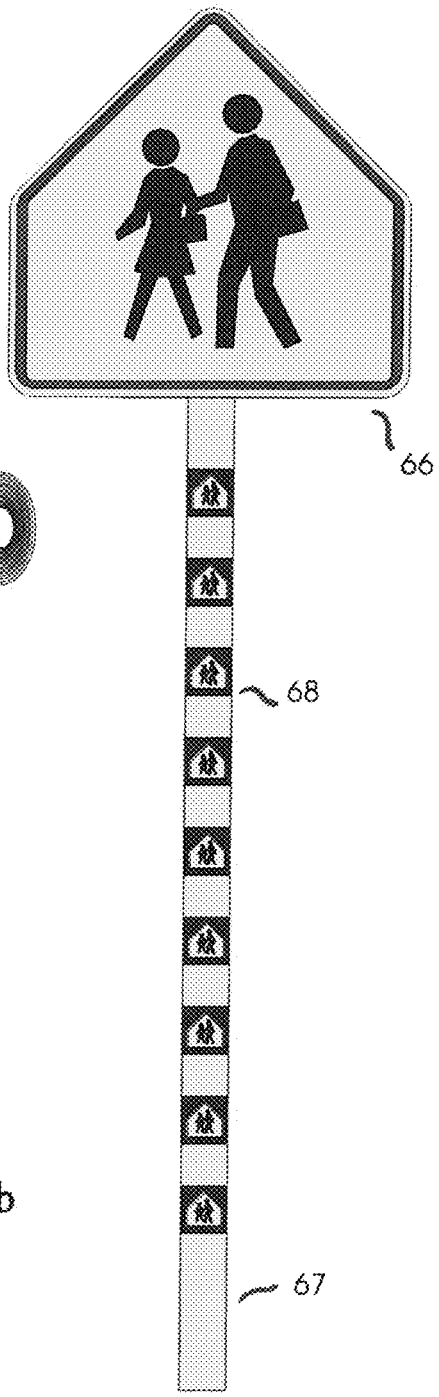
FIG. 13*c* is a front view showing a school sign and a high visibility colored support with the printed clear transparent material in FIG. 13*a* applied to the support structure showing the sign support structure color through the clear transparent film or sheet material.
Figure 14:
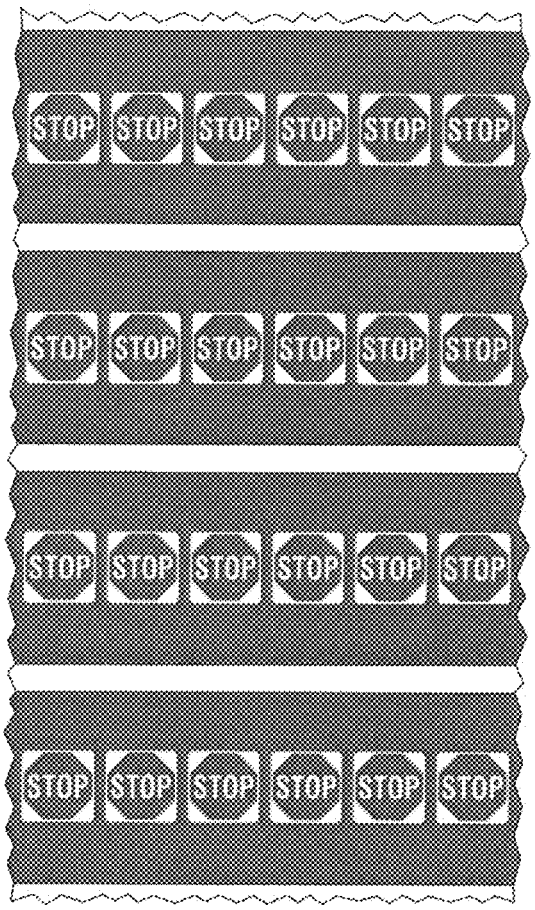
FIG. 14 is a top plan view of my invention showing one option of a manufacturing process to provide a continuous wide film or sheet, incorporating a random design, that can be slit vertically, as shown, to provide either long rolls or individual pieces of desired length. The edges of the border are shown broken away to indicate indeterminate length and width and being understood that the pattern repeats uniformly throughout the desired width and length.
Figure 15:
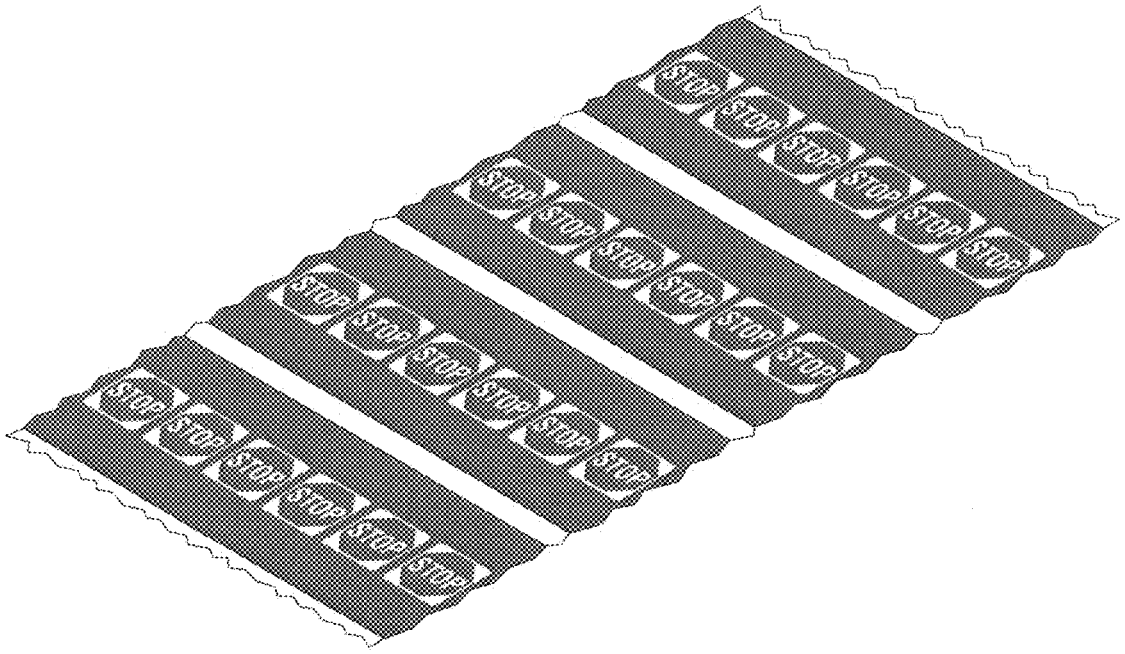
FIG. 15 is a perspective view of FIG. 14
Figure 16:
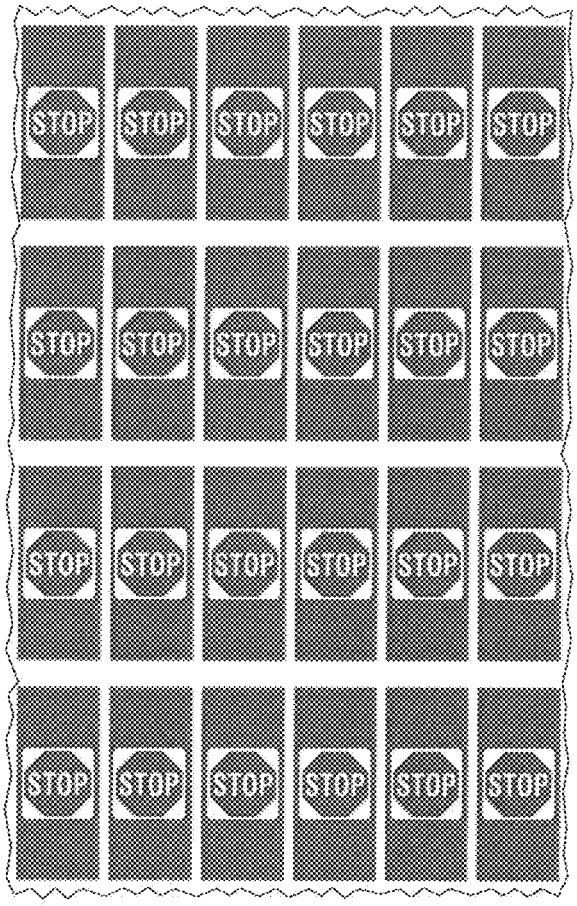
FIG. 16 is a top plan view of my invention showing another option of a manufacturing process to provide a continuous wide film or sheet incorporating a random design that can be slit vertically, as shown, to provide either long rolls or individual pieces of desired length leaving a plain border around each design. The edges of the border are shown broken away to indicate indeterminate length and width and being understood that the pattern repeats uniformly throughout the desired width and length.
Figure 17:
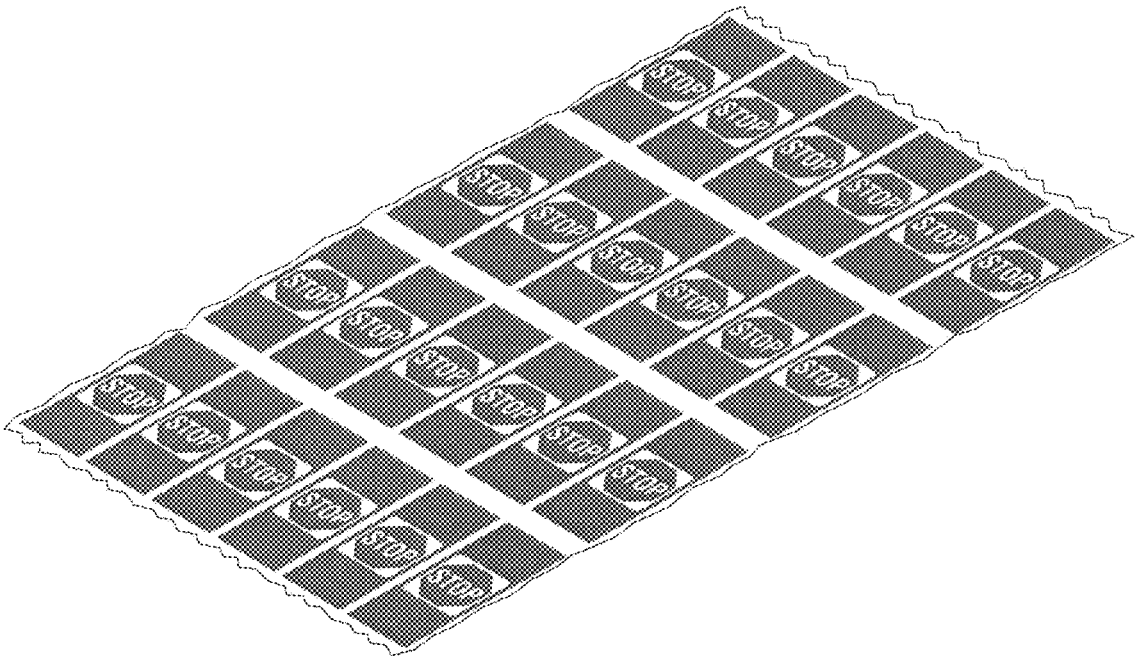
FIG. 17 is a perspective view of FIG. 16
Figure 18:
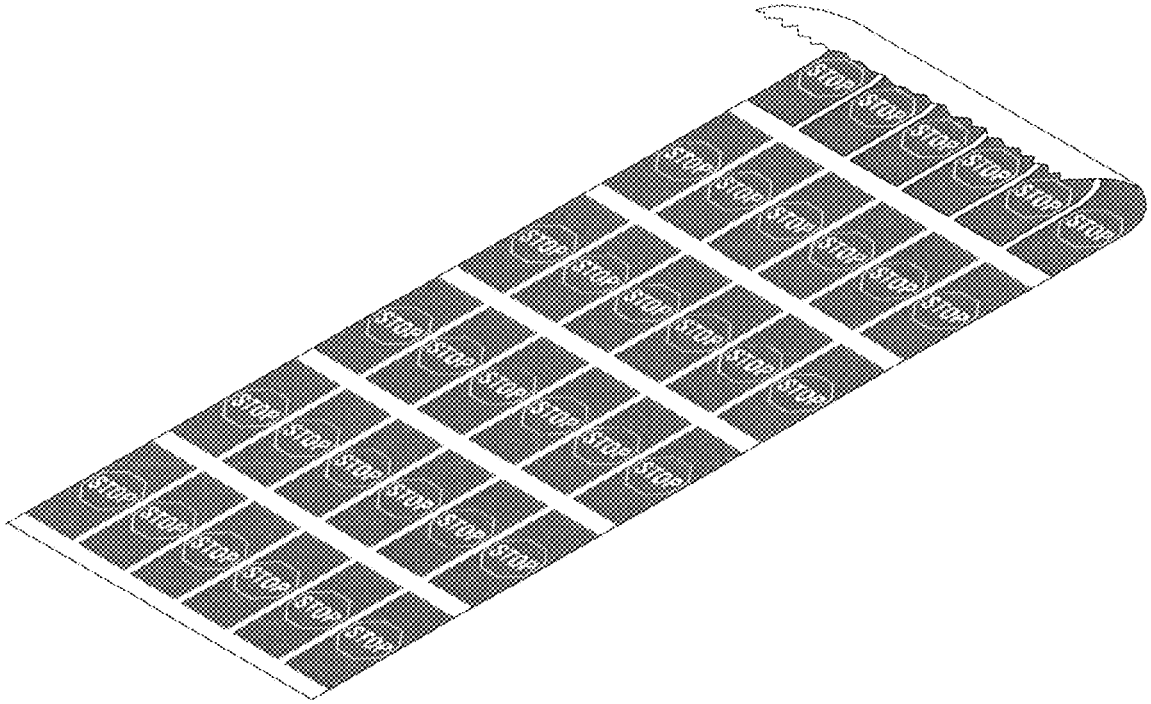
FIG. 18 is a perspective view of my invention showing a random width of film or sheet material, incorporating a random design, cut off on one end and broken away at the other end to show an indeterminate length.

FIG. 13 illustrates a small section of a decal type system with the clear transparent film or sheet material 61 on which a dark contrasting design 62 is applied. FIG. 13*a* illustrates a longer section of a clear transparent film or sheet material 63 on which a dark contrasting design 64 is applied. FIG. 13*b* illustrates the clear transparent film or sheet material with dark contrasting design applied as manufactured or produced in roll form 65. FIG. 13*c* illustrates a school sign 66 mounted on a yellow support structure 67 on which the clear transparent film or sheet material with dark contrasting design 68 is applied. The color of the support structure 67 is seen through the clear transparent film or sheet material with the dark contrasting design on the material, highly visible. This embodiment of the present invention can utilize a post, holding a school sign, as a substrate or base on which a daytime high visibility material may be applied. Material could be a daytime high visibility coating or a daytime high visibility film or sheeting on which is printed or overlaid with a contrasting colored notice, such as the national sign for school zone, school crossing or the words spelled out. If a plain colored material or coating is applied to the sign support structure, a clear transparent decal type material, such as a clear transparent film or sheeting with printing, in contrasting darker color, design, words or letters may be used along with contrasting colors or alternating contrasting colors to attract attention.

Wide widths of film or sheeting, retro-reflective, clear or transparent, can be printed with the previously mentioned contrasting colors, designs, words or letters during the manufacturing process or as a post manufacturing process as illustrated in FIG. 14-FIG. 18 then cut to the desired length or slit along the length of the master roll to produce several single rolls. Individual narrow rolls can be unrolled to the desired length and cut prior to application A further process by which rolls or strips of a material can be produced is by printing on narrow width rolls of film or sheeting by a roll to roll process, preferably utilizing a UV curing process, thereby producing individual rolls or cutting the material into desired lengths after printing. Although the description above contains many examples, these should not be construed as limiting the scope of this invention but merely provide illustrations of some of the presently preferred embodiments.

What is claimed is:

1. A traffic skin comprising in combination, a flexible elongated retro-reflective film or sheet comprising indicia of alphanumeric and/or graphic symbols corresponding to a traffic or informational sign, said indicia replicated repeatedly at predetermined intervals along the length of said flexible elongated retro-reflective film or sheet creating pattern of contrasting colors;

a sign panel comprising indicia of alphanumeric and/or graphic symbols the same as the indicia replicated repeatedly on said flexible elongated retro-reflective film or sheet and;

a vertical sign supporting post having a front facing surface said sign panel attached to a top of the vertical sign post wherein;

said flexible elongated retro-reflective film or sheet is attached to the front facing surface of said vertical sign supporting post such that the indicia on the flexible elongated retro-reflective film or sheet and the indicia on the sign panel are visible simultaneously.

2. The traffic sign of claim 1 wherein; said retro-reflective film or sheet is attached to a flat planar independent substrate; said flat planar independent substrate is secured to the front facing surface of said sign post.

3. A traffic sign comprising in combination, a flexible retro-reflective film or sheet comprising indicia of alphanumeric and/or graphic symbols, said indicia replicated repeatedly at predetermined intervals along the length of said elongated retro-reflective film or sheet creating a pattern of contrasting colors;

a sign panel comprising indicia of alphanumeric and/or graphic symbols the same as the indicia replicated repeatedly on said flexible elongated retro-reflective film or sheet;

a vertical sign supporting post having front facing surface and;

an elongated flat planar independent substrate wherein;

said elongated retro-reflective film or sheet is attached to said elongated flat planar independent substrate, said elongated flat planar independent substrate is mounted to the front facing surface of said post such that the indicia on the flexible elongated retro-reflective film or sheet and the indicia on the sign panel are visible simultaneously.

4. The traffic sign of claim 3 wherein;

said retro-reflective film or sheet comprises a means to secure said flexible elongated retro-reflective film or sheet to said flat planar independent substrate secured to the front facing surface of said sign supporting posts.

* * * * *